United States Patent [19]

Ricoux et al.

[11] Patent Number: 4,779,782

[45] Date of Patent: Oct. 25, 1988

[54] GUIDANCE DEVICE FOR MATERIAL IN STRIP FORM, ESPECIALLY FOR A SHEET METAL TREATMENT PLANT

[75] Inventors: Jean Ricoux, Saint-Etienne; Jacques Nesme, Monistrol S/Loire; Michel Pabiou, Fraisses, all of France

[73] Assignee: Usinor Chatillon, Firminy, France

[21] Appl. No.: 904,972

[22] Filed: Sep. 8, 1986

[30] Foreign Application Priority Data

Sep. 10, 1985 [FR] France ..... 85 13418

[51] Int. Cl.[4] ..... B65H 23/00

[52] U.S. Cl. ..... 226/21; 226/18

[58] Field of Search ..... 198/806, 807, 840; 226/15, 18, 21, 22, 23

[56] References Cited

U.S. PATENT DOCUMENTS

| | | | |
|---|---|---|---|
| 2,225,276 | 12/1940 | Parker | 198/806 |
| 3,032,248 | 5/1962 | Morrow | 226/189 |
| 3,109,572 | 11/1963 | Herr | 226/189 |
| 3,986,650 | 10/1976 | Swanke et al. | 226/21 |
| 4,572,417 | 2/1986 | Joseph et al. | 226/21 X |
| 4,641,770 | 2/1987 | Hediger | 226/21 X |

FOREIGN PATENT DOCUMENTS

| | | | |
|---|---|---|---|
| 843998 | 7/1952 | Fed. Rep. of Germany . | |
| 2025745 | 12/1970 | Fed. Rep. of Germany . | |
| 2305689 | 9/1973 | Fed. Rep. of Germany | 226/21 |
| 2428113 | 1/1976 | Fed. Rep. of Germany . | |
| 1101433 | 11/1955 | France . | |
| 1577084 | 8/1969 | France . | |
| 2186940 | 1/1974 | France . | |
| 2336331 | 7/1977 | France . | |
| 132206 | 10/1981 | Japan | 198/806 |
| 26708 | 2/1983 | Japan | 198/806 |

*Primary Examiner*—Daniel P. Stodola

*Attorney, Agent, or Firm*—Cushman, Darby & Cushman

[57] ABSTRACT

Guidance device for material traveling in strip form, especially for a sheet metal treatment plant, which includes a guidance roller (13) over which the strip (20) passes. This roller is carried by a movable structure (10) itself mounted on a fixed structure (1), so as to be capable of oscillating around an axis (Y—Y) contained in a median plane at right angles to the axis (X—X) of the roller, tangent to this roller and forming an angle of between 5° and 30° with the upstream length (21) of the strip.

7 Claims, 5 Drawing Sheets

GUIDANCE DEVICE FOR MATERIAL IN STRIP FORM, ESPECIALLY FOR A SHEET METAL TREATMENT PLANT

The present invention relates to guidance devices for materials in strip form, and their applications.

In plants for treating an elastoplastic product which is in strip form and, especially, in plants for the treatment of hot- or cold-rolled sheet metal strips, it is necessary to use devices for guiding these strips. This is particularly the case in heat treatment furnaces and in accumulators which are generally arranged at the entry and/or at the exit of the treatment plants.

A guidance device of this type generally comprises a guidance roller mounted rotationally around its axis on a movable structure, itself supported by a fixed structure, actuating and retaining members being provided for moving and retaining the movable structure in relation to the fixed structure.

In a first known arrangement, the movable structure supporting the guidance roller is mounted so as to be capable of oscillating around an axis which may be defined as the intersection of a median plane at right angles to the axis of the roller with a plane containing the upstream length of the strip. If the strip moves in a vertical plane, then the axis of oscillation of the movable structure and, consequently, of the guidance roller, is found to be vertical, tangent to the roller and contained in the median plane of the latter. An arrangement of this kind has a major inconvenience which lies in an excessively long reaction time, given that the movable structure and hence the guidance roller must be moved with considerable amplitude in order to effect a correction of the strip and to return the latter into a centred position. Furthermore, the correction is ineffective so far as the upstream length is concerned and the control of a device of this kind is difficult, taking into account this considerable amplitude of movement.

Another arrangement has therefore been proposed, in which the movable structure is supported in relation to the fixed structure so as to be capable of oscillating around an axis which is also contained in the median plane at right angles to the axis of the roller, but which extends at right angles to the plane of the strip, at a certain distance below the axis of the roller. In an arrangement of this kind, if the strip moves in a vertical plane, then the axis of rotation is horizontal, whereas it was vertical in the first device described.

The response time of this second device is much shorter but, on the other hand, it has another disadvantage, which consists in an elongation and a distortion of the strip at its edges, this disadvantage being particularly severe in the case of thin metal sheets, that is to say metal sheets which have a thickness of less than approximately 0.4 mm.

Furthermore, this known device results in the speed of the strips being limited to a value which cannot exceed 25 m/min; it should be added, furthermore, that this upper limit is attained only if a manual control is added to the traditional automatic control device.

The purpose of this invention is consequently to provide a guidance device for elastoplastic materials in strip form, which does not have any of the disadvantages referred to above and which, consequently, offers a response time which is sufficiently short without, however, giving rise to an unacceptable distortion of the material passing through the device.

To this end, the subject of the invention is a guidance device for a strip of elastoplastic material, comprising a guidance roller mounted rotationally around its axis on a movable structure, itself supported by a fixed structure, actuating and retaining means being provided for moving and retaining the movable structure in relation to the fixed structure, characterized in that the movable structure is mounted on the fixed structure so as to be capable of oscillating around an axis contained in a median plane at right angles to the axis of the roller and forming an angle of between 5° and 30° with either length or with both lengths of the strip.

According to other characteristics:

the axis of oscillation is at least substantially tangent to the roller;

the axis of oscillation is tangent to the roller in the vicinity of the upstream length of the strip;

the fixed structure defines a plane which is inclined to the horizontal and comprises bearing and guidance means interacting with matching means carried by the movable structure;

the bearing and guidance means comprise three subassemblies, each comprising at least one pair of bearing surfaces and a pair of cylindrical guidance surfaces centred on the axis of oscillation between the two structures;

the roller is carried by a structure mounted on an intermediate structure so as to be capable of oscillating in relation to this intermediate structure around an axis contained in a median plane, at right angles to the axis of the cylinder, extending at right angles to the length of the strip and situated at a certain distance below the axis of the roller, the intermediate structure itself being mounted on the fixed structure so as to be capable of oscillating around an axis such as defined above;

immobilizing means are provided, on the one hand, between the movable structure and the intermediate structure and, on the other hand, between the intermediate structure and the fixed structure.

A more detailed description of the invention will be given below with reference to the attached drawing, given solely by way of example, in which.

Figure 1:
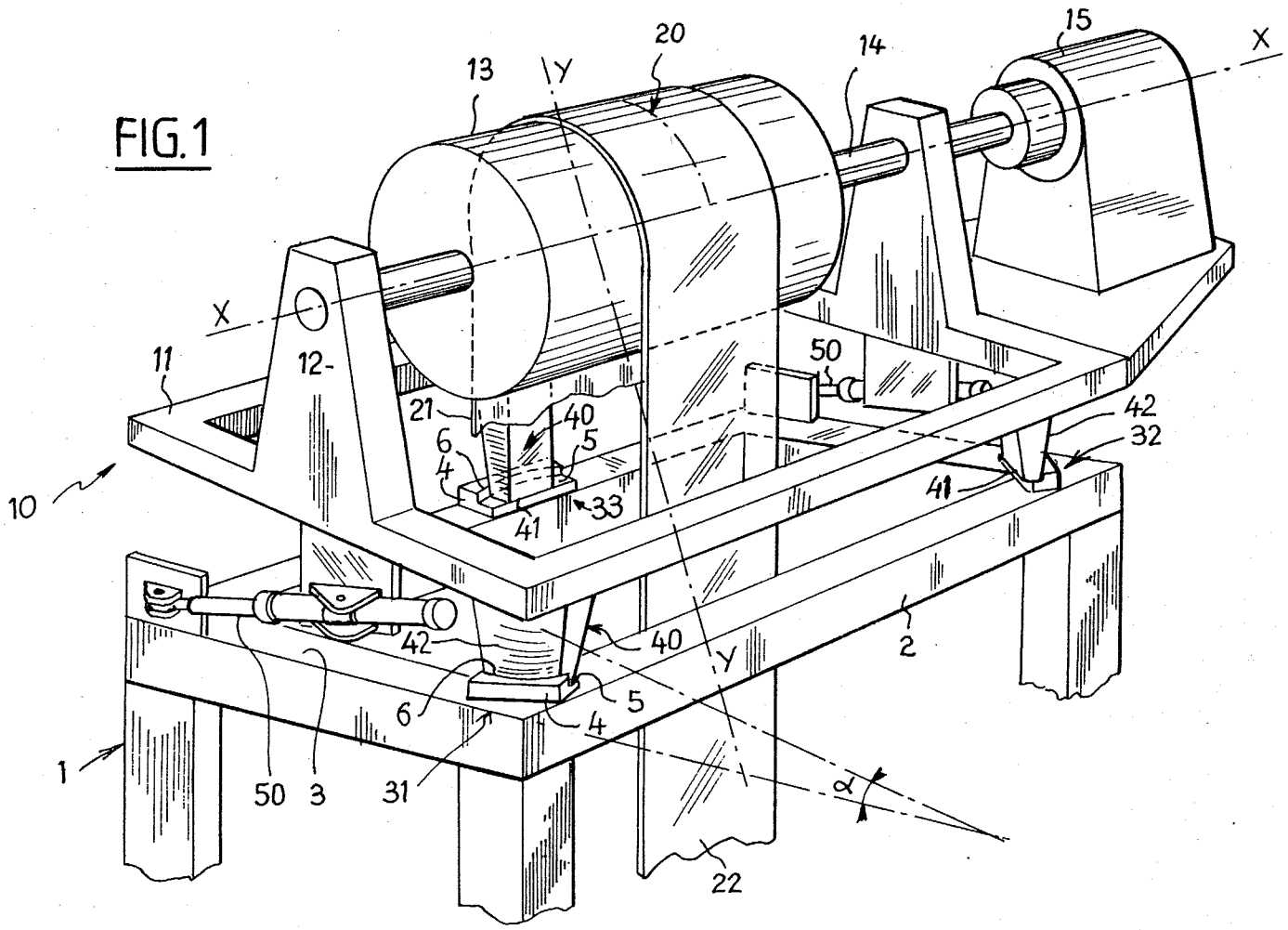
FIG. 1 is a diagrammatic perspective view of a guidance device according to the invention.

The guidance device shown in the drawings may be arranged, for example, in a strip heat treatment furnace, or alternatively in an accumulator.

This device, in the form shown in FIG. 1, comprises a fixed structure 1 made in any appropriate manner and which in its upper part comprises a frame 2 defining an inclined plane 3 forming an angle $\alpha$ of between 5° and 30°, and, for example, close to 10°, to the horizontal in a particular embodiment. Supported on this fixed structure there is a movable structure 10, also comprising a frame 11 and fitted with two bearing supports 12, between which a guidance roller 13 carried by a shaft 14 is mounted in rotation. This roller is capable of rotating around its axis X—X and can be driven in rotation by a motor 15. Over the roller 13 passes a strip 20 whose two upstream 21 and downstream 22 lengths are vertical in this case and which is to be maintained in a centred position on the roller.

In the embodiment shown, the movable structure is mounted on the fixed structure so as to be capable of oscillating around an axis Y—Y at right angles to the inclined plane 3 defined by the fixed structure, tangent to the roller 13 on that side of the latter which receives the upstream length 21 of the strip, and, finally, contained in the median plane of the roller, at right angles to the axis X—X.

Figure 2:
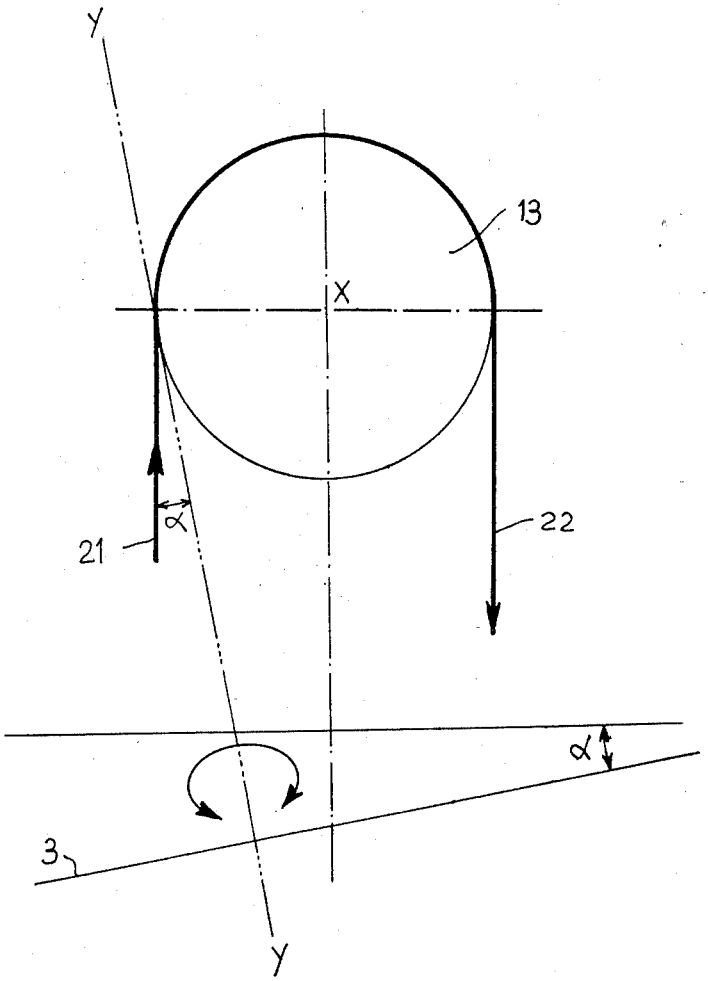
FIG. 2 is a diagram showing the position of the axis of rotation or of oscillation of the guidance roller.

The position of the axis Y—Y of oscillation of the movable structure can be seen clearly if reference is made to the diagram in FIG. 2, which is assumed to be contained in the abovementioned median plane of the roller. Thus, this axis Y—Y forms an angle to the vertical which is equal to the angle $\alpha$ of inclination of the plane 3, that is to say an angle of between 5° and 30° and close to 10° in the example shown.

In this embodiment, the means by which the movable structure bears on the fixed structure comprise three bearing assemblies 31, 32, 33, two of which 31, 32 are arranged in the upper part of the frame 2 and the other 33 in the lower part of this same frame. Each bearing assembly comprises a block 4 forming an integral part of the fixed structure and defining a bearing surface 5 and a cylindrical guidance surface 6 centred on the axis Y—Y, and a foot 40 carried by the movable structure and itself also defining a bearing surface 41 and a cylindrical guidance surface 42. These surfaces are made of or coated with a suitable antifriction material.

Figure 4:
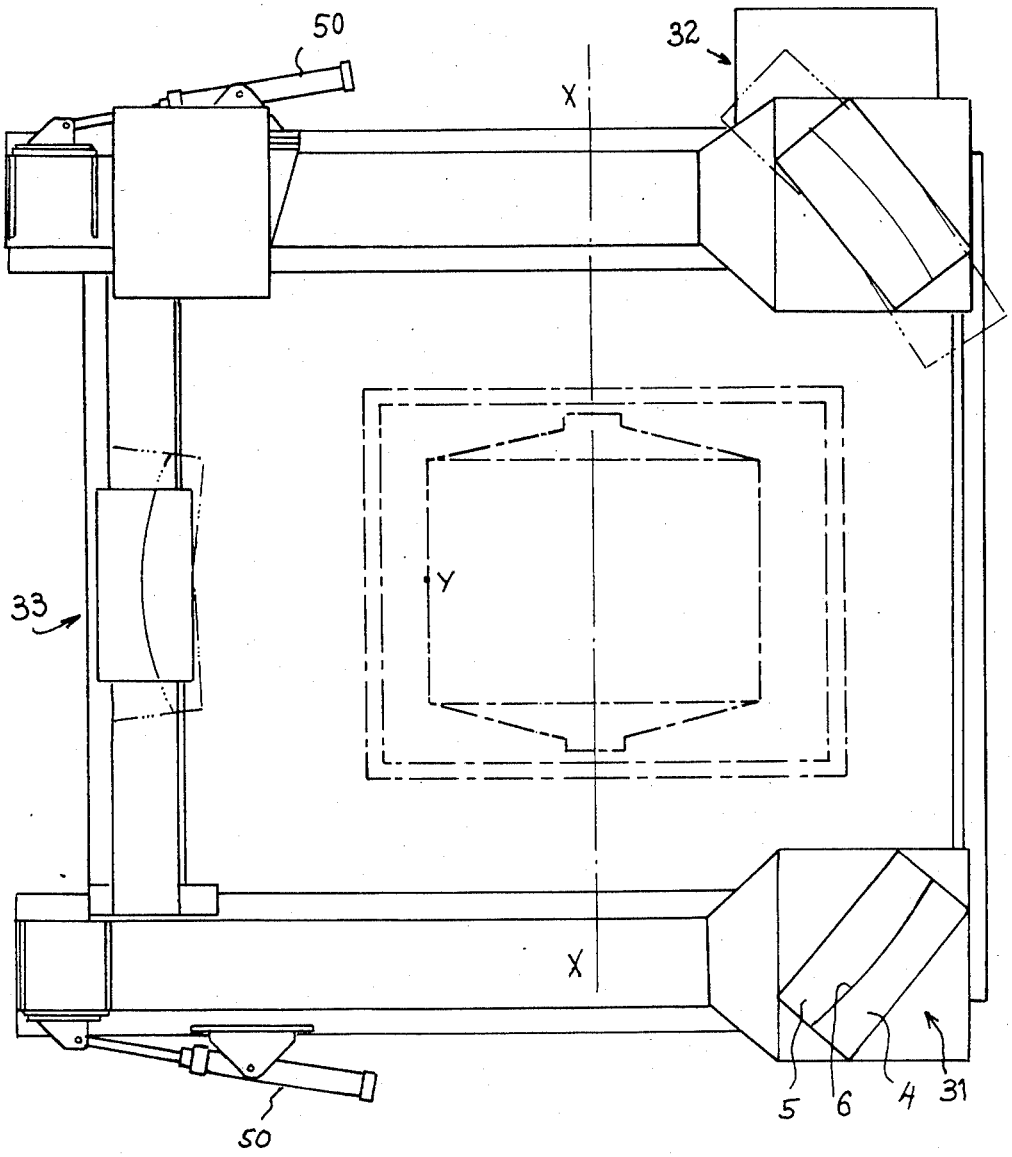
FIG. 4 is a view in cross-section taken along line 4—4 in FIG. 3.

In the example shown, as can be seen more clearly in FIG. 4, the guidance surfaces associated with the lower assembly 33 have a shorter radius than the guidance surfaces of the other two bearing assemblies, being closer to the axis of oscillation Y—Y.

The device is supplemented by means for actuating and for retaining the movable structure in relation to the fixed structure. These actuating means comprise two jacks 50 arranged on two opposite sides of these structures and connected to a control device, known per se, and which will not be described in detail here. This control device comprises means for supplying the jacks with hydraulic fluid and a control circuit comprising photoelectric cells or other sensors of the position of the strip which, depending on the latter's position, are responsible for feeding the jacks so as to move the movable structure in an appropriate direction to bring the strip back into its centred position.

This result is obtained by causing the movable structure to oscillate around the axis Y—Y, it being possible for the angular range of movement between the two extreme positions of the guidance roller to be, for example, of the order of 15° in a particular application.

In the example shown in the drawing, the axis of oscillation of the movable structure in relation to the fixed structure has been shown strictly tangent to the roller.

The position of this axis may, of course, be slightly offset without substantially modifying thereby the operation of the device. Similarly, the angle formed by this axis with a reference direction which may be the direction of the adjacent length of the strip to be guided may be chosen from a range of between 5° and 30°, preferably between 7° and 20°, for the applications in question.

The advantages offered by this arrangement, as compared to the known arrangements, are the following:

the movement of the guidance roller which takes place in order to bring the strip back into a centred position produdes little distortion of the strip edges: thus, for a 100-mm side movement of the strip, the edge elongation is 4 mm for a given strip, whereas with the second previously known device described at the beginning of this specification, for a 100-mm side movement of the strip, the edge elongation was 16 mm for a given strip.

The invention thus enables the edge elongation to be divided by 4.

This is especially important when the strips subjected to this guidence are of very low thickness, for example less than 0.40 mm;

this device has a satisfactory response time;

it produdes a considerable guidance effect in the downstream lengh and a moderate effect in the upstream length, insofar as the axis of oscillation of the movable structure is intangent to the roller in the vicinity of the generatrix of contact between the upstream length of the strip and the roller; naturally, this effect could be reversed by placing the axis of oscillation on the side of the downstream length, or could also be divided between the two lengths by placing the axis of oscillation between these two extreme positions;

it enables the speed of travel of the strips to be appreciably increased; for example, a speed of 35 m/min may be attained without manual intervention, that is to say merely by using an automatic control device of traditional design. Higher speeds, for example of the order of 45 m/min, may be envisaged, the upper speed limit being then imposed by factors which are independent of the guidance.

Figure 3:
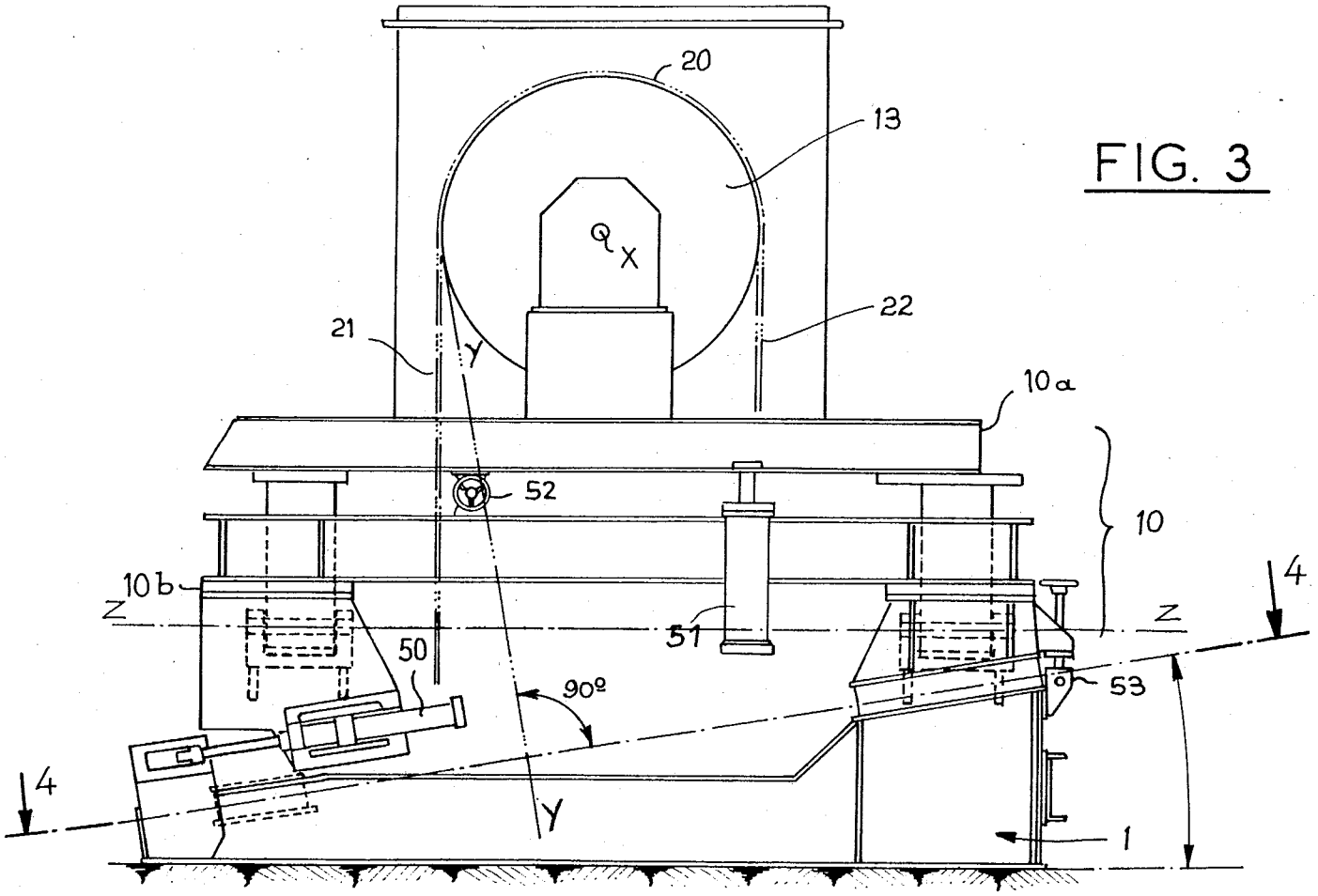
FIG. 3 is a side elevation view of another embodiment of a device of this kind.
Figure 5:
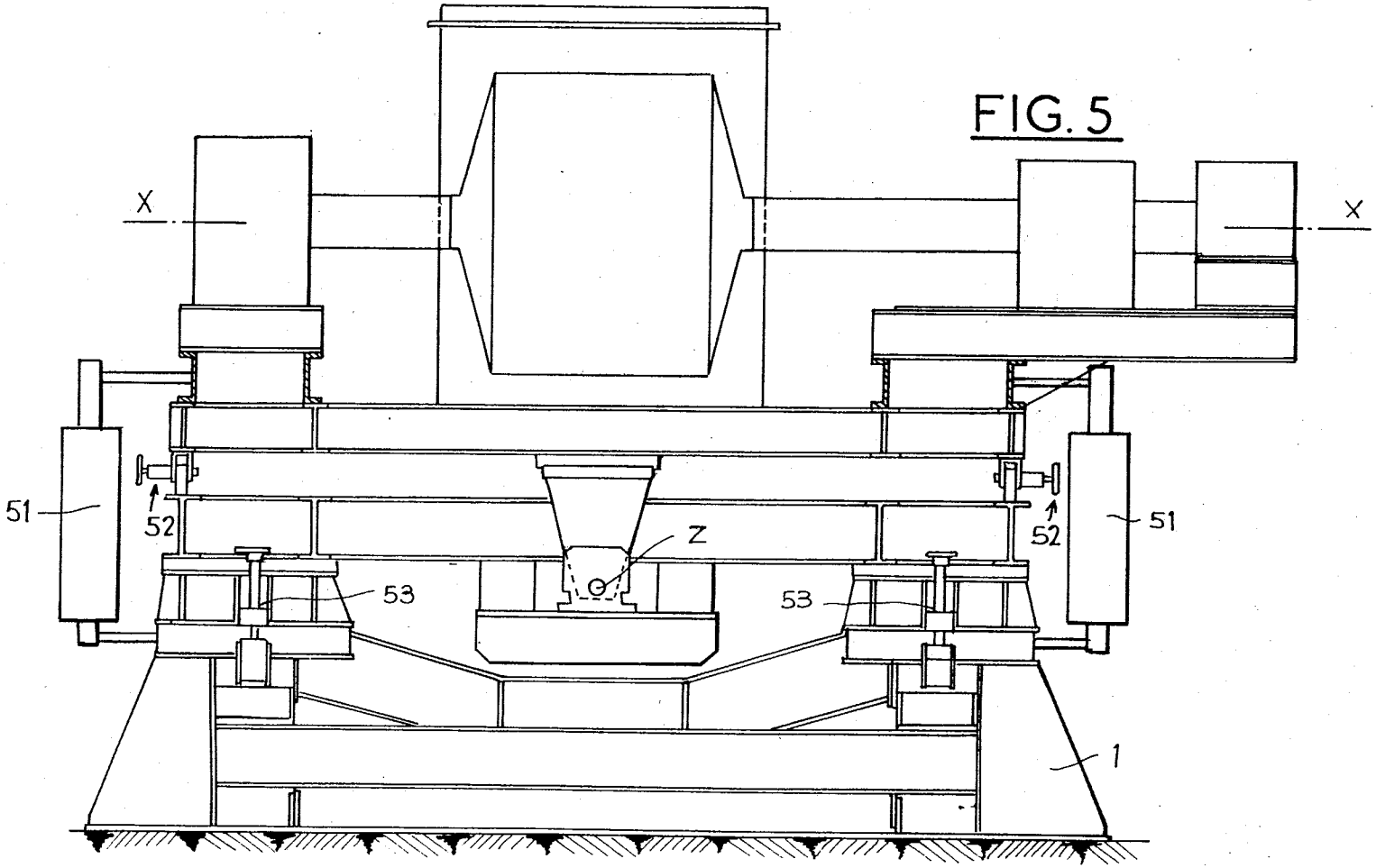
FIG. 5 is a view from the right of the device in FIG. 3.

By way of an alternative form of this device, it may be stated that it is possible to combine it with one of the previously known devices; thus, in the embodiment shown in FIGS. 3 to 5, the roller is carried by a structure **10*a* mounted in relation to an intermediate structure 10*b*, in accordance with the teaching of the second previously known device described at the beginning of this specification, that is to say, oscillating around a horizontal axis Z—Z at right angles to the axis X—X and situated at a certain distance below this axis X—X. This intermediate structure 10*b* is itself mounted on the fixed structure 1 in accordance with the invention. Actuating jacks 51 are provided to move the structure 10*a* in relation to the structure 10*b*, as are locking devices 52, 53 to fix integrally and selectively the structure 10*a* to the structure 10*b*, or alternatively the structure 10*b* to the structure 1**.

An arrangement such as this makes it possible to combine the advantages of both elementary devices.

Naturally, other alternative forms may be envisaged without departing from the scope of this patent, particularly as regards the construction of the various components of the device and their guidance and/or actuating means. In particular, the means for guiding the movable structure in relation to the fixed structure may consist of ball or needle thrust bearings, a crown wheel or any other appropriate means.

What is claimed is:

1. A guidance device for a traveling strip of elastoplastic material comprising:

a guidance roller, over which the strip is trained, mounted rotationally around its axis on a movable structure, itself supported by a fixed structure; retaining and actuating means for retaining and moving said movable structure in relation to said fixed structure around a first axis contained in a median plane at right angles to said roller axis and forming an angle (α) of between 5° and 30° with at least one straight length of the strip extending from said roller, said fixed structure defining a plane which is inclined at said angle (α) to the horizontal; and bearing and guidance means interengaged between said structures for restraining said movable structure for movement relative to said fixed structure about said first axis, said bearing and guidance means comprising three subassemblies, each comprising at least one pair of bearing surfaces and a pair of cylindrical guidance surfaces centered on said first axis.

2. The device as claimed in claim 1, wherein said first axis is at least substantially tangent to the roller.

3. The device as claimed in claim 2, wherein said first axis is tangent to the roller in the vicinity of the upstream length of the strip.

4. The device as claimed in claim 1, wherein two of the subassemblies are placed in the upper part of the inclined plane and the third subassembly is placed in the lower part of the inclined plane.

5. The device as claimed in claim 1, wherein the inclined plane has a lower part which is located closer to the upstream length of the strip.

6. The device as claimed in claim 1, wherein the movable structure mounted on an intermediate structure so as to be capable of oscillating in relation to this intermediate structure around a second axis contained in a median plane, at right angles to the axis of the roller, extending at right angles to the one length of the strip and situated at a distance below the axis of the roller, the intermediate structure itself being mounted on the fixed structure so as to be capable of oscillating around said first axis.

7. The device as claimed in claim 6, wherein means for selectively locking against relative movement are provided, on the one hand, between the movable structure and the intermediate structure and, on the other hand, between said intermediate structure and the fixed structure.

* * * * *